US010883794B2

(12) United States Patent
Jen et al.

(10) Patent No.: US 10,883,794 B2
(45) Date of Patent: Jan. 5, 2021

(54) QUICK-DETACH MOUNT FOR QUICK-DETACH ACCESSORIES ON FIREARMS

(71) Applicant: Strike Industries, Inc., Santa Ana, CA (US)

(72) Inventors: Yi Huei Jen, Santa Ana, CA (US); David Hyung Chin, Irvine, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/550,169

(22) Filed: Aug. 23, 2019

(65) Prior Publication Data

US 2020/0011636 A1 Jan. 9, 2020

Related U.S. Application Data

(63) Continuation-in-part of application No. 15/852,232, filed on Dec. 22, 2017, now Pat. No. 10,480,896, which is a continuation-in-part of application No. 14/725,353, filed on May 29, 2015, now abandoned, and a continuation-in-part of application No. 14/675,484, filed on Mar. 31, 2015, now Pat. No. 9,891,020, and a continuation-in-part of application No. 14/529,045, filed on Oct. 30, 2014, now Pat. No. 10,473,432.

(60) Provisional application No. 62/722,785, filed on Aug. 24, 2018.

(51) Int. Cl.
*F41C 27/00* (2006.01)
*F41C 23/16* (2006.01)

(52) U.S. Cl.
CPC ..... *F41C 27/00* (2013.01); *F41C 23/16* (2013.01)

(58) Field of Classification Search
CPC ..... F41C 23/02; F41C 27/00
USPC ..... 42/85, 90
See application file for complete search history.

(56) References Cited

U.S. PATENT DOCUMENTS

2009/0288325 A1* 11/2009 Esch ..... F41C 23/02 42/85

* cited by examiner

*Primary Examiner* — Reginald S Tillman, Jr.
(74) *Attorney, Agent, or Firm* — Han IP PLLC; Andy M. Han

(57) ABSTRACT

A detachable firearm attachment implementable on a firearm includes a main body having a firearm attachment side and an accessory attachment side. The firearm attachment side is configured to attach to a surface of a part of the firearm. The accessory attachment side includes a socket configured such that a detachable device is coupled to and decoupled from the socket along an axis of the socket that is at an angle less than 90° from the surface of the part of the firearm. The socket is further configured with one or more indentation chambers on a surface of a cavity of the socket in which the detachable device is received when the detachable device is coupled to the socket such that, when the detachable device is coupled to the socket, a rotation of the detachable device is prevented by the one or more indentation chambers.

18 Claims, 14 Drawing Sheets

(A)

(B)

QUICK-DETACH MOUNT FOR QUICK-DETACH ACCESSORIES ON FIREARMS

CROSS REFERENCE TO RELATED PATENT APPLICATIONS

The present disclosure claims the priority benefit of U.S. Patent Application No. 62/722,785, filed on 24 Aug. 2018, and is also part of a continuation-in-part (CIP) application of U.S. patent application Ser. No. 15/852,232, filed on 22 Dec. 2017, which claims the priority benefit of, U.S. patent application Ser. No. 14/529,045, filed on 30 Oct. 2014, U.S. patent application Ser. No. 14/675,484, filed on 31 March 205 and issued as U.S. Pat. No. 9,891,020 on 13 Feb. 2018, and U.S. patent application Ser. No. 14/725,353, filed on 29 May 2015. Contents of the above-listed applications are herein incorporated by reference in their entirety.

TECHNICAL FIELD

The present disclosure is generally related to firearms and, more particularly, to a quick-detach mount for quick-detach accessories on firearms.

BACKGROUND

Unless otherwise indicated herein, approaches described in this section are not prior art to the claims listed below and are not admitted as prior art by inclusion in this section.

Many shooters use various accessories to enhance their firearm and/or to provide additional functionality which allows for improved firearm utilization. One of such accessories is a quick-detach or quick-disconnect (QD) mount, which is typically attached onto a handguard or a rail of the firearm, and the QD mount allows a sling or another type of accessory to be detachably connected to firearm via the QD mount. For instance, a sling may have one or more QD swivels each of which can be detachably connected to a socket on a respective QD mount.

However, in terms of ergonomics, existing designs of QD mount tend to be less than ideal as they tend to have relatively high profile protruding from the firearm. In particular, the socket on a typical QD mount is designed such that a QD swivel is connected to and detached from the QD mount along an axis of the socket which is perpendicular to the side of the handguard or rail on which the QD mount is mounted. This design tends to make it rather difficult for a user to maneuver (e.g., as the high profile makes it easy to snag on clothing or other objects).

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

It is an objective of the present disclosure to propose a QD mount that addresses aforementioned issues with existing designs of QD mounts. Moreover, it is an objective of the present disclosure to propose a QD mount that can be attached to the older KeyMod platform as well as the newer M-LOK platform. That is, the present disclosure aims to provide a multi-platform, low-profile, snag-free QD mount that can be easily installed/removed and easily accessible, thereby making the firearm more ergonomic.

In one aspect, a detachable firearm attachment implementable on a firearm may include a main body having a firearm attachment side and an accessory attachment side. The firearm attachment side may be configured to attach to a surface of a part of the firearm. The accessory attachment side may include a socket configured such that a detachable device is coupled to and decoupled from the socket along an axis of the socket that is at an angle less than 90° from the surface of the part of the firearm.

In another aspect, a detachable firearm attachment implementable on a firearm may include a main body having a firearm attachment side and an accessory attachment side. The firearm attachment side may be configured to attach to a surface of a part of the firearm. The accessory attachment side may include a socket configured such that a detachable device is coupled to and decoupled from the socket along an axis of the socket that is at an angle less than 90° from the surface of the part of the firearm (e.g., 45° or a different angle in a range of 15°~75° or the range of 30°~60°). In such cases, the socket may be configured to receive a quick-detach (QD) swivel as the detachable device, and the socket may be further configured with one or more indentation chambers on a surface of a cavity of the socket in which the detachable device is received when the detachable device is coupled to the socket such that, when the detachable device is coupled to the socket, a rotation of the detachable device is prevented by the one or more indentation chambers.

It is noteworthy that, although examples provided in the present disclosure may be related to a certain type of firearms (e.g., AR15), various embodiments in accordance with the present disclosure may be adapted or otherwise implemented in different types of firearms. For instance, various embodiments in accordance with the present disclosure may be utilized with semiautomatic pistols, semiautomatic rifles, semiautomatic carbines, bolt-action rifles, as well as other types of firearms. Therefore, the scope of the present disclosure is not limited to examples provided herein.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

Overview

Figure 1:
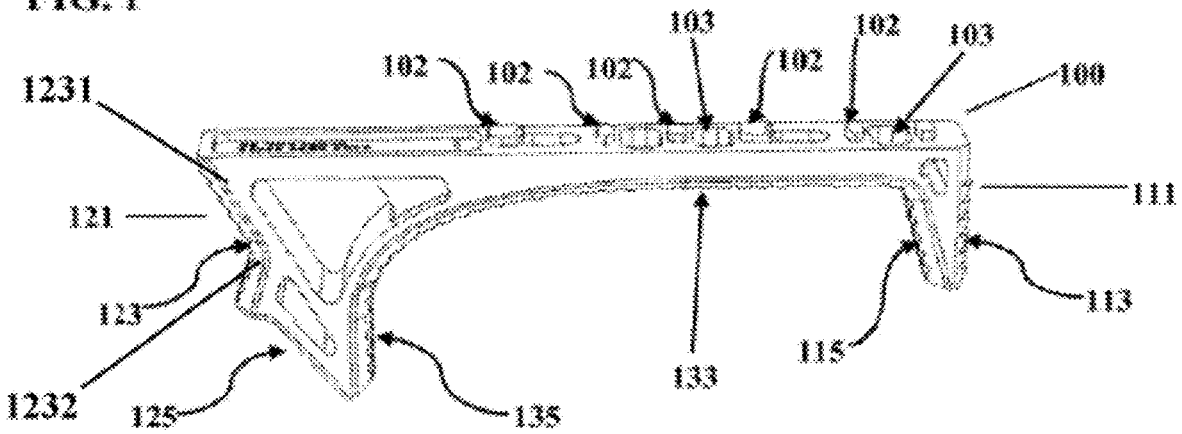
FIG. 1 is an illustration of an embodiment of the present disclosure.
Figure 2:
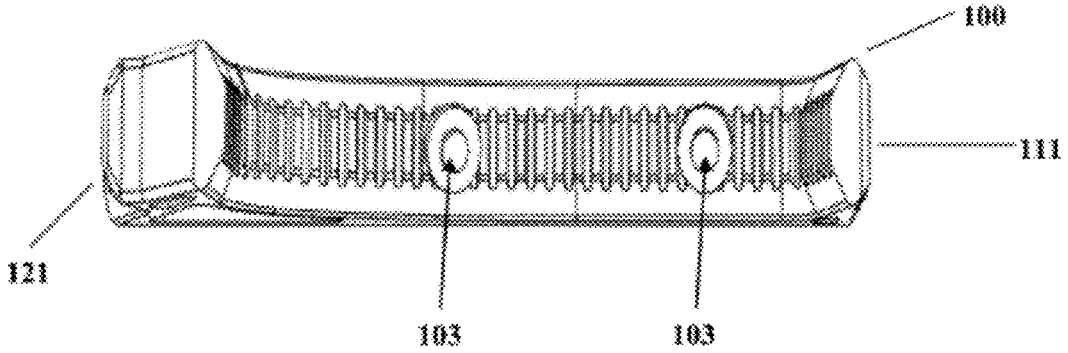
FIG. 2 is a bottom view of an embodiment of the present disclosure.
Figure 3:
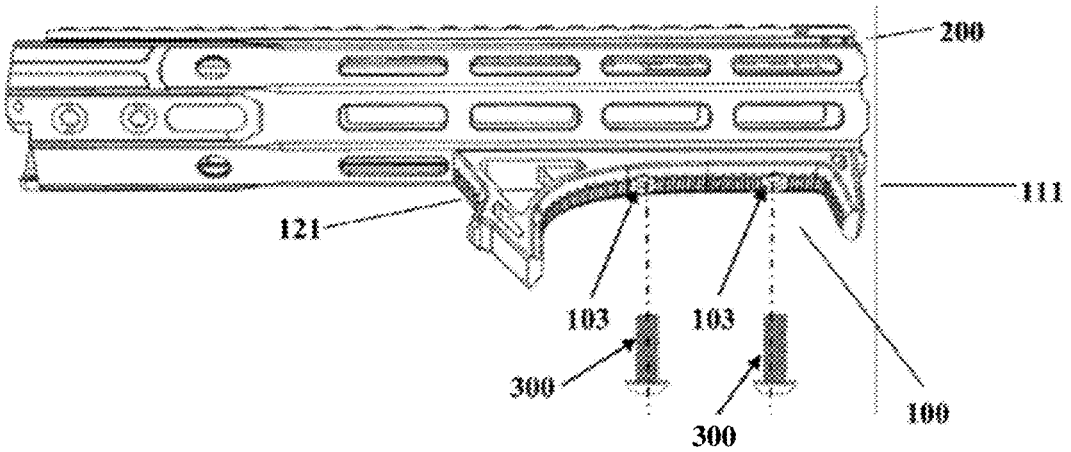
FIG. 3 is an illustration of an embodiment positioned on a firearm handguard in accordance with an implementation of the present disclosure.
Figure 4:
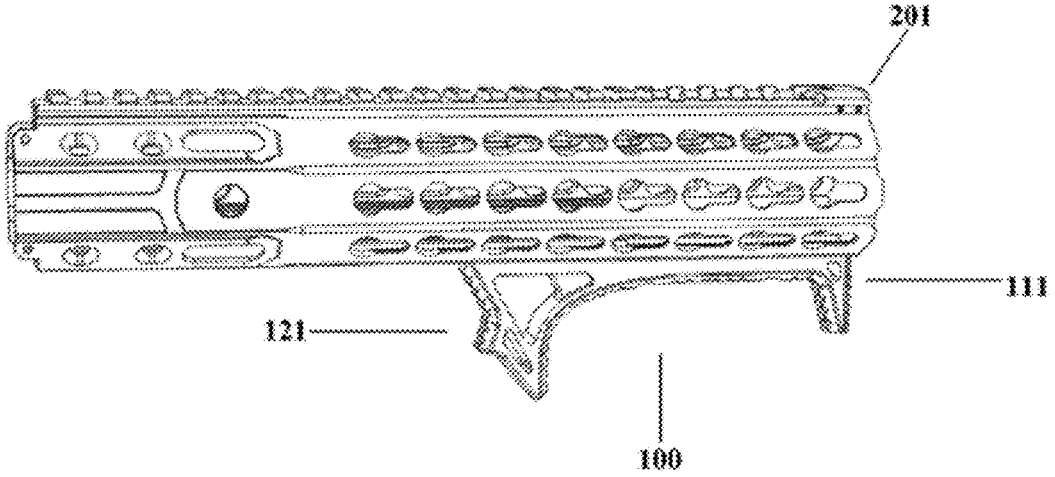
FIG. 4 is an illustration of an embodiment attached on one style of a firearm handguard in accordance with an implementation of the present disclosure.
Figure 5:
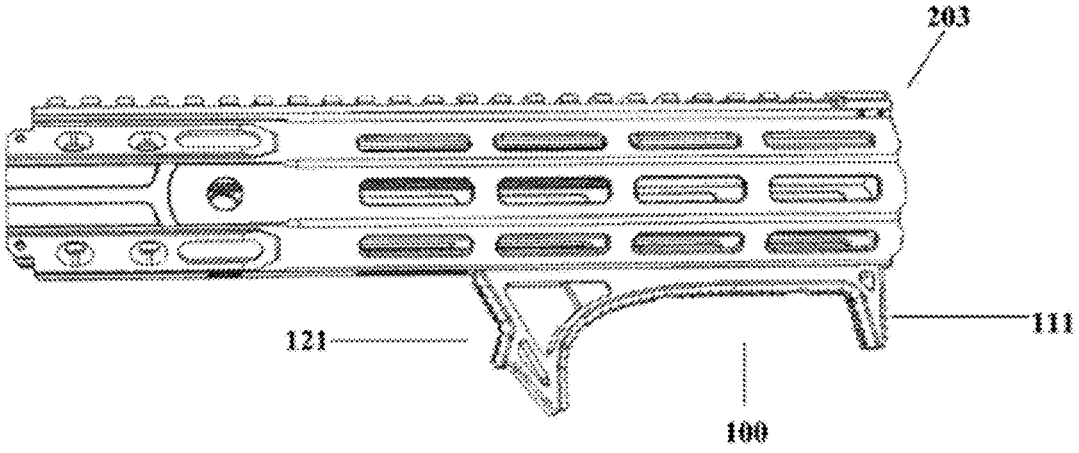
FIG. 5 is an illustration of an embodiment attached on another style of a firearm handguard in accordance with an implementation of the present disclosure.
Figure 6:
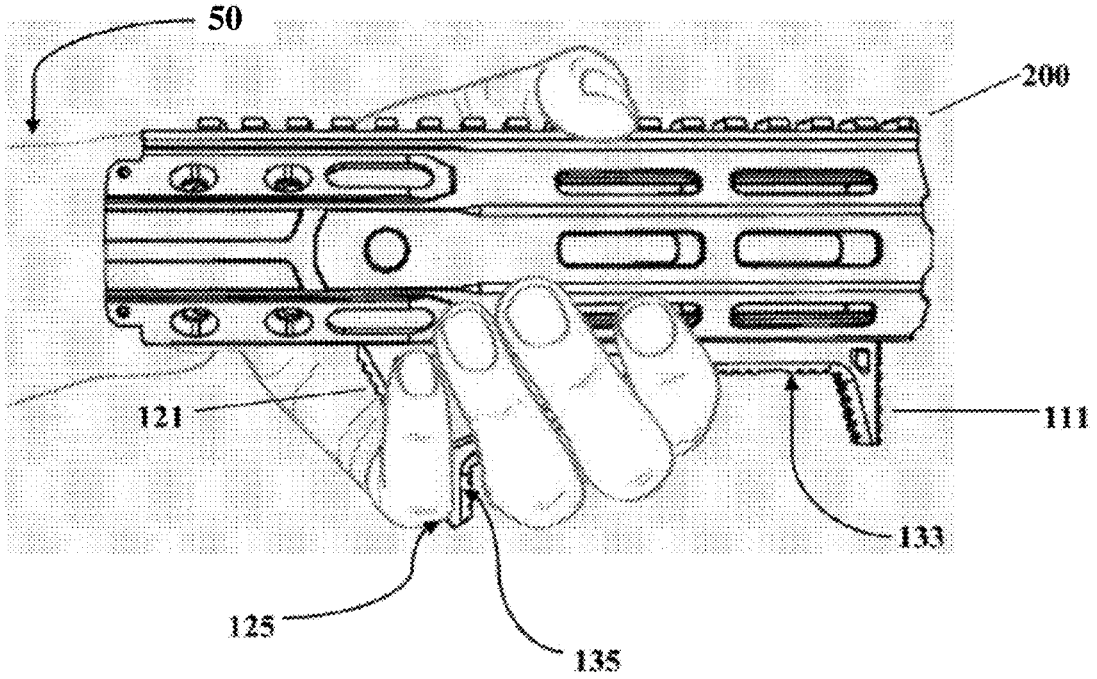
FIGS. 6-9 are illustrations of different methods that an embodiment of the present disclosure can be utilized by a shooter in holding a firearm handguard.

FIG. 1 is an illustration of a multi-platform ergonomic foregrip 100 in accordance with the present disclosure. This illustration shows a plurality of engagement, attachment and positioning features. On the attachment surface of multi-platform ergonomic foregrip 100, positioning lugs 102 are present to guide a user 50 in the installation process. These lugs 102 allows multi-platform ergonomic foregrip 100 to be positioned appropriately, prior to securing the apparatus, on different handguard mounting platforms. This is apparent in FIGS. 4 and 5 which each illustrate different mounting platforms, in this case the KeyMod mounting platform and the M-LOK handguard mounting platform, respectively. Insertion of a fastener 300 via fastener holes 103, shown in FIG. 2, and illustrated in FIG. 3 will provide a method for securing multi-platform ergonomic foregrip 100 onto a firearm handguard 200.

Referring to FIG. 1, multi-platform ergonomic foregrip 100 further features a front end 111 and a rear end 121 separated by a horizontal engagement portion 133, which runs from the front end, and a curved engagement portion 135 which connected the horizontal engagement portion 133 to the rear end 121.

Figure 7:
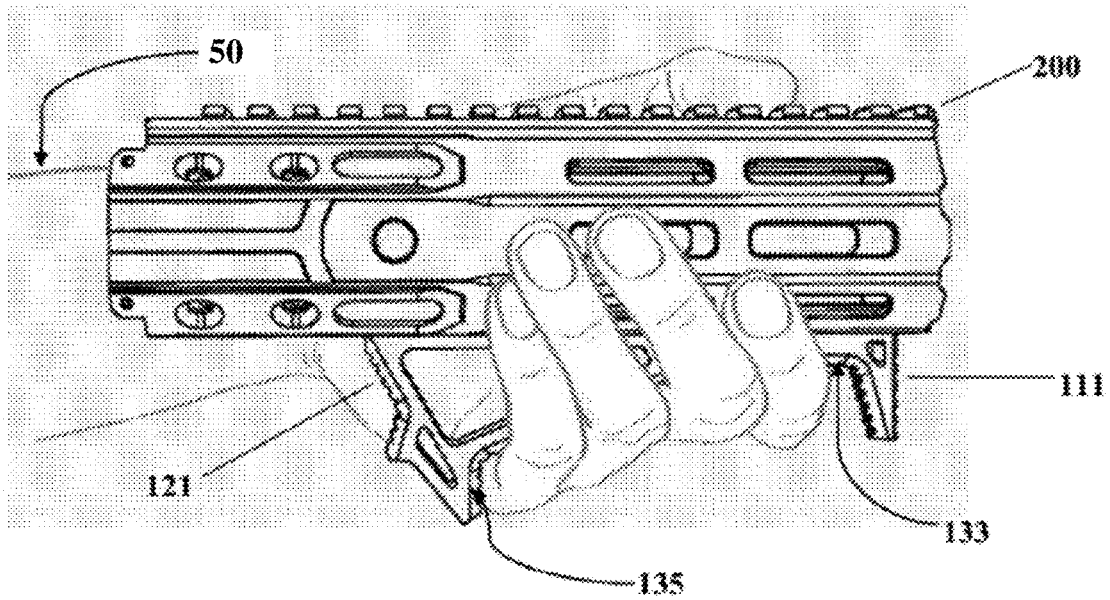
Figure 8:
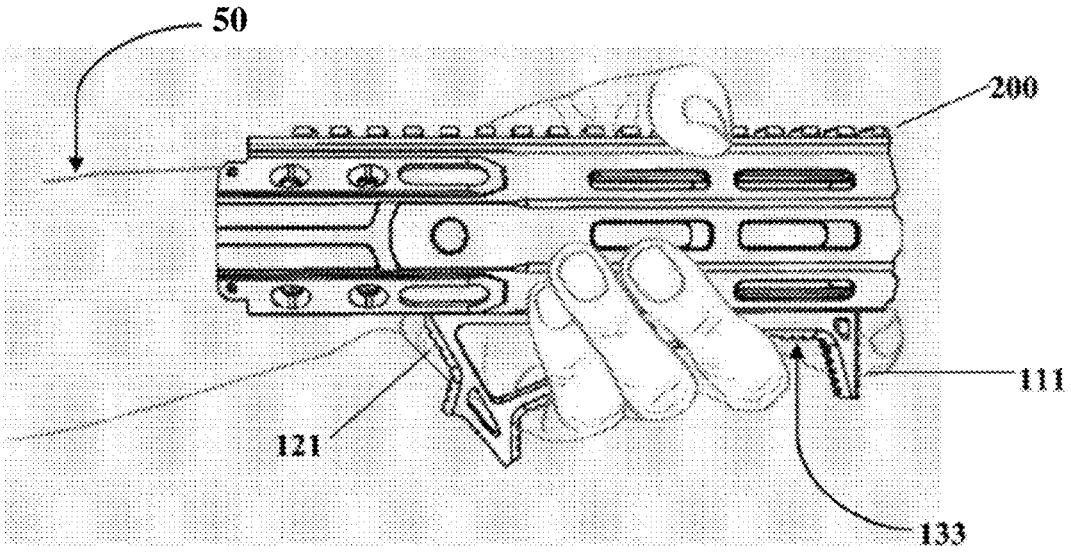
Figure 9:
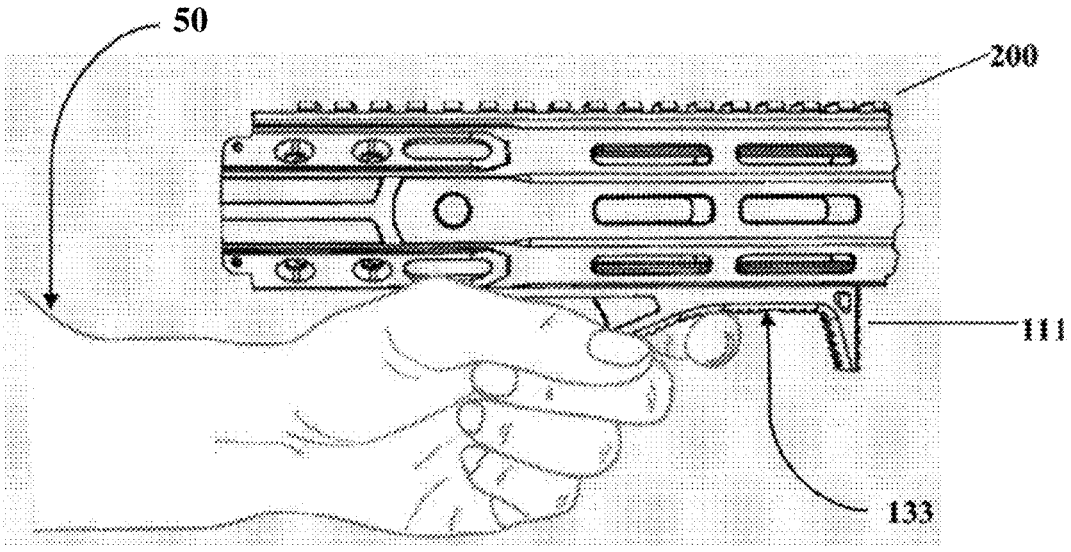

The front end further comprises a vertical member defined by a first vertical engagement surface 113 (herein interchangeably referred as an "outer vertical surface") and a second vertical engagement surface 115 (herein interchangeably referred as an "inner vertical surface") by which a user 50 can utilize in a method similar to that shown in both FIG. 8 and FIG. 9. The rear end 121 further comprises two engagement surfaces wherein a first engagement surface 123, having a first angled grip surface 1231 and a second angled grip surface 1232 connecting at an angle over ninety (90) degrees, provides a position for a user 50 to utilize a method of holding multi-platform ergonomic foregrip 100, as illustrated in FIG. 7. The rear end 121 also features a second engagement surface 125 by which a shooter can position their hand on the handguard. In some embodiments, multi-platform ergonomic foregrip 100 also features the curved engagement portion 135 and the horizontal engagement surface 133 by which a user 50 can effectively position their hand or a finger to provide additional grip and better firing control as shown in FIGS. 6 through 9.

FIGS. 10-15 show the mounting interface either in a disassembled apparatus or interacting with keyhole-shaped openings 410 of the KeyMod handguard rail system and rounded-rectangular openings 420 of the M-LOK handguard rail system. The mounting interface comprises three parts: a multi-platform accessory rail 100A with a top surface 112 and a bottom surface 114 that comprises an array of alignment relief lugs 110, a fastener screw 350, and a pivot fastener nut 360.

Figure 10:
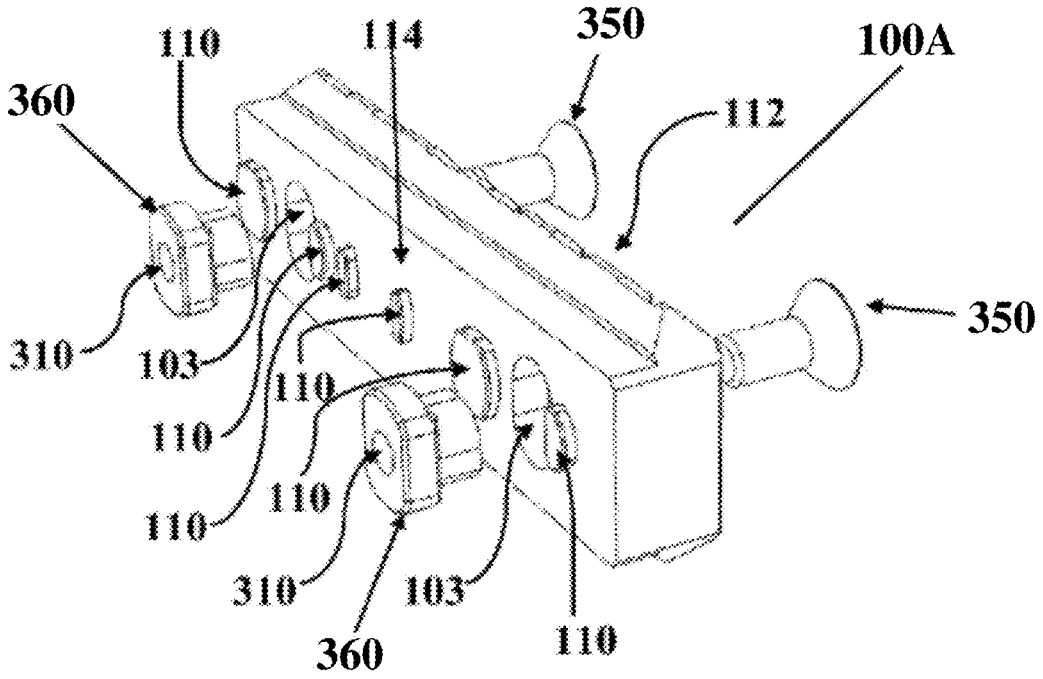
FIG. 10 is an exploded view of an embodiment of the present disclosure.

FIG. 10 shows the components of the mounting interface in an exploded view which shows that insertion of the pivot fastener nut 360 into the fastener hole 103 located on the bottom surface 114 of multi-platform accessory rail 100A will provide a threadably couplable fastener hole 310 by which tightening fastener screw 350 can threadably attach onto through a top surface 112 opening of the fastener hole 103. Fastener screw 350 may be, for example and without limitation, a socket cap screw that has a hexagonal drive hole, a Phillips drive hole, or another type hole. That is, the shape of a drive hole on fastener screw 350 may resemble, for example and without limitation, a hexagon, a cross, a straight line, a six-pointed star, a twelve-pointed star, or a multi-pointed star.

Figure 11:
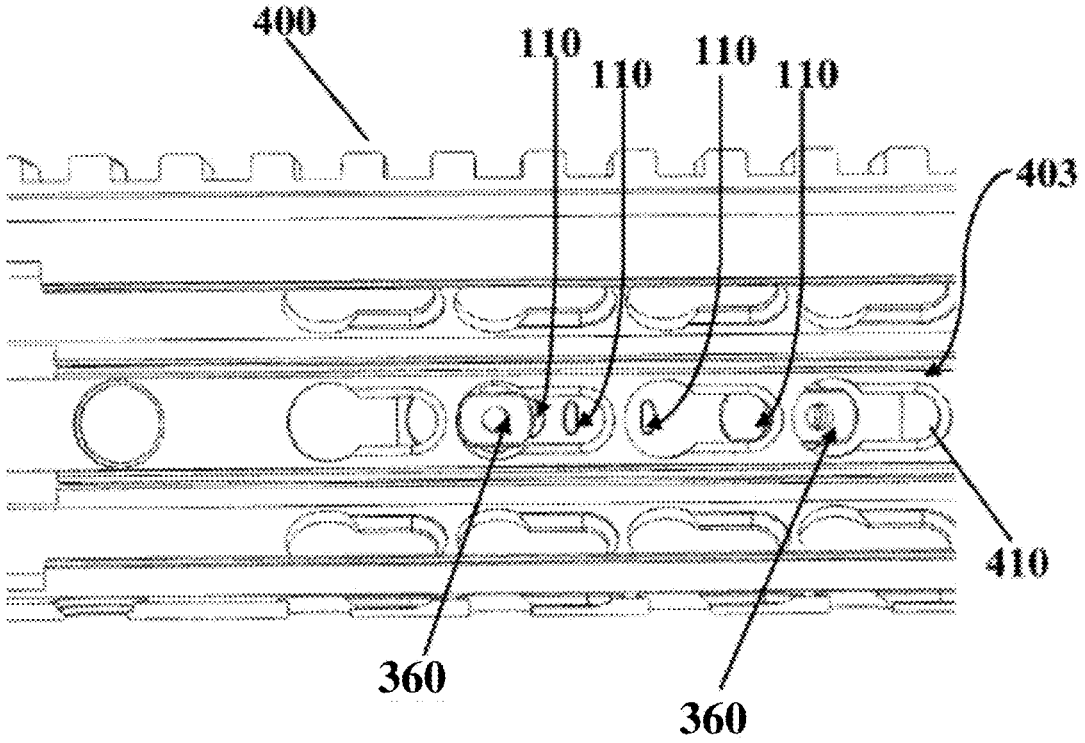
FIG. 11 is a bottom surface view of an embodiment aligned onto cutaway of a firearm handguard rail system in accordance with an implementation of the present disclosure.
Figure 12:
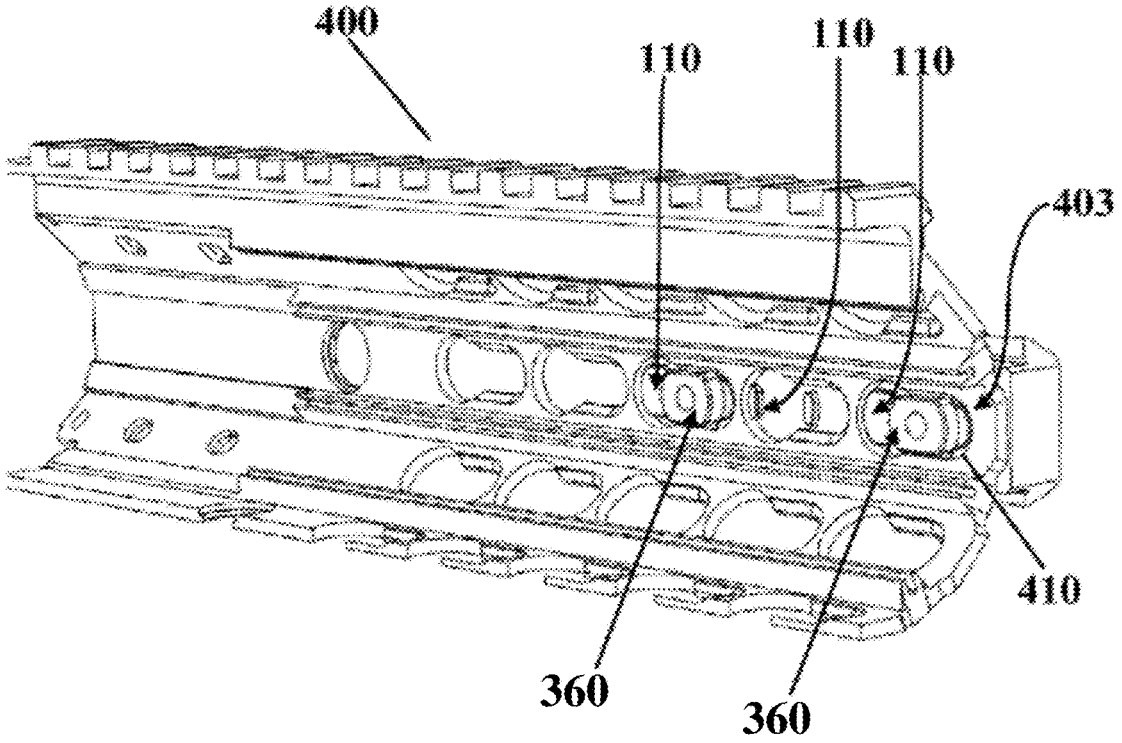
FIG. 12 is a bottom surface view of an embodiment removably coupled onto a firearm handguard rail system in accordance with an implementation of the present disclosure.

FIG. 11 shows the mounting interface aligned onto keyhole-shaped openings 410 of the KeyMod handguard rail system via alignment lugs 110 which physically contact with the rail system and prevents sliding along the rail system. This alignment will mean that the pivot fastener nut 360 can be inserted into the keyhole-shaped openings 410 of the KeyMod handguard rail system. FIG. 12 shows the mounting interface both aligned and locked in place on the keyhole-shaped openings 410 of the KeyMod handguard rail system of the handguard 400 via alignment lugs 110 and pivot fastener nut 360, respectively. Pivot fastener nut 360 engages the inner surface 403 of the handguard 400 by rotating the tightening fastener screw 350 shown in FIG. 10. In some embodiments, alignment lugs 110 may be of the same size and the same shape. Alternatively, alignment lugs 110 may be of different sizes and/or different shapes.

Figure 13:
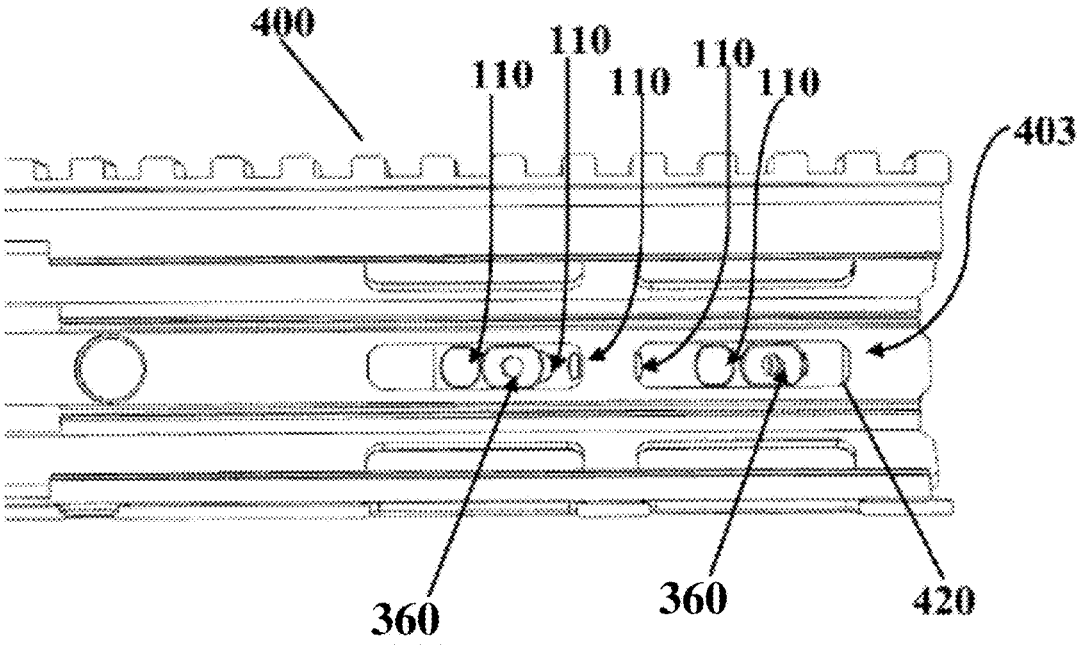
FIG. 13 is a bottom view of an embodiment aligned onto cutaway of a different firearm handguard rail system in accordance with an implementation of the present disclosure.
Figure 14:
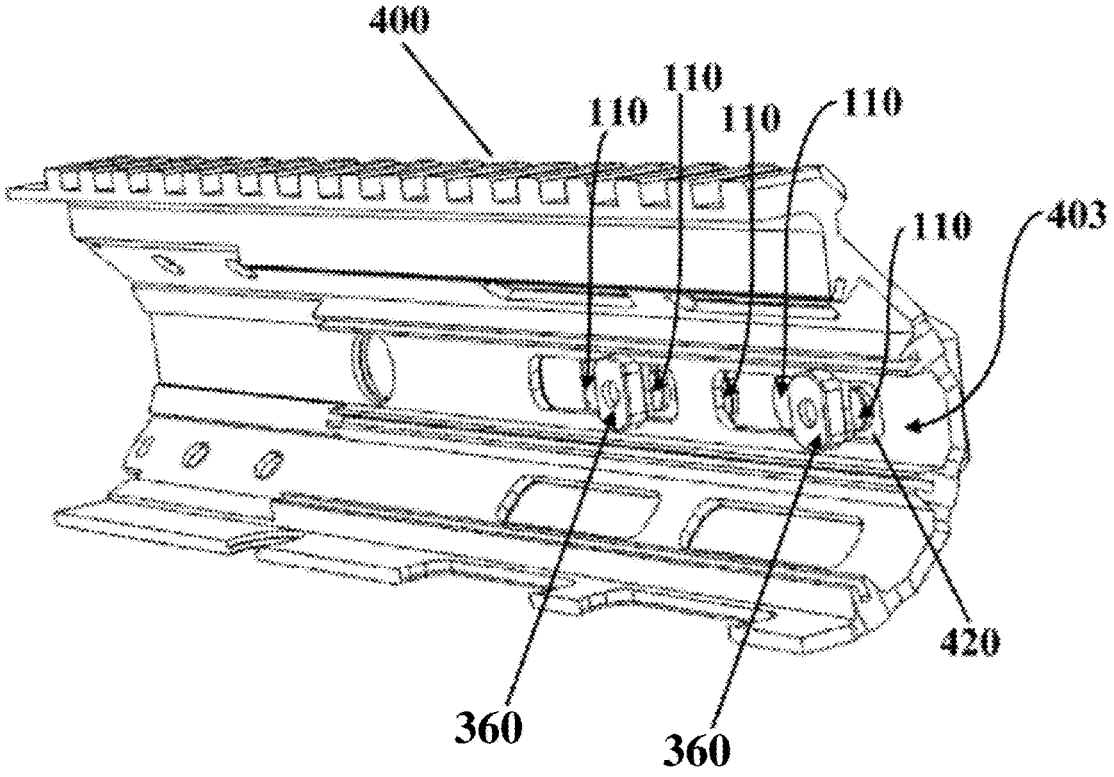
FIG. 14 is a bottom surface view of an embodiment removably coupled onto a firearm handguard rail system in accordance with an implementation of the present disclosure.

FIG. 13 shows the mounting interface aligned onto rounded-rectangular openings 420 of the M-LOK handguard rail system via alignment lugs 110 which physically contact with the rail system and prevents sliding along the rail system. This alignment will mean that the pivot fastener nut 360 can be inserted into the rounded-rectangular openings 420 of the M-LOK handguard rail system. FIG. 14 shows the mounting interface both aligned and locked in place on the keyhole-shaped openings 410 of the KeyMod handguard rail system of the handguard 400 via alignment lugs 110 and pivot fastener nut 360, respectively. Pivot fastener nut 360 engages the handguard 400 by rotating the tightening fastener screw 350 shown in FIG. 10 which in turn rotates the pivot fastener nut 360 such that the pivot fastener nut 360 engages the inner surface 403 of handguard 400.

Figure 15:
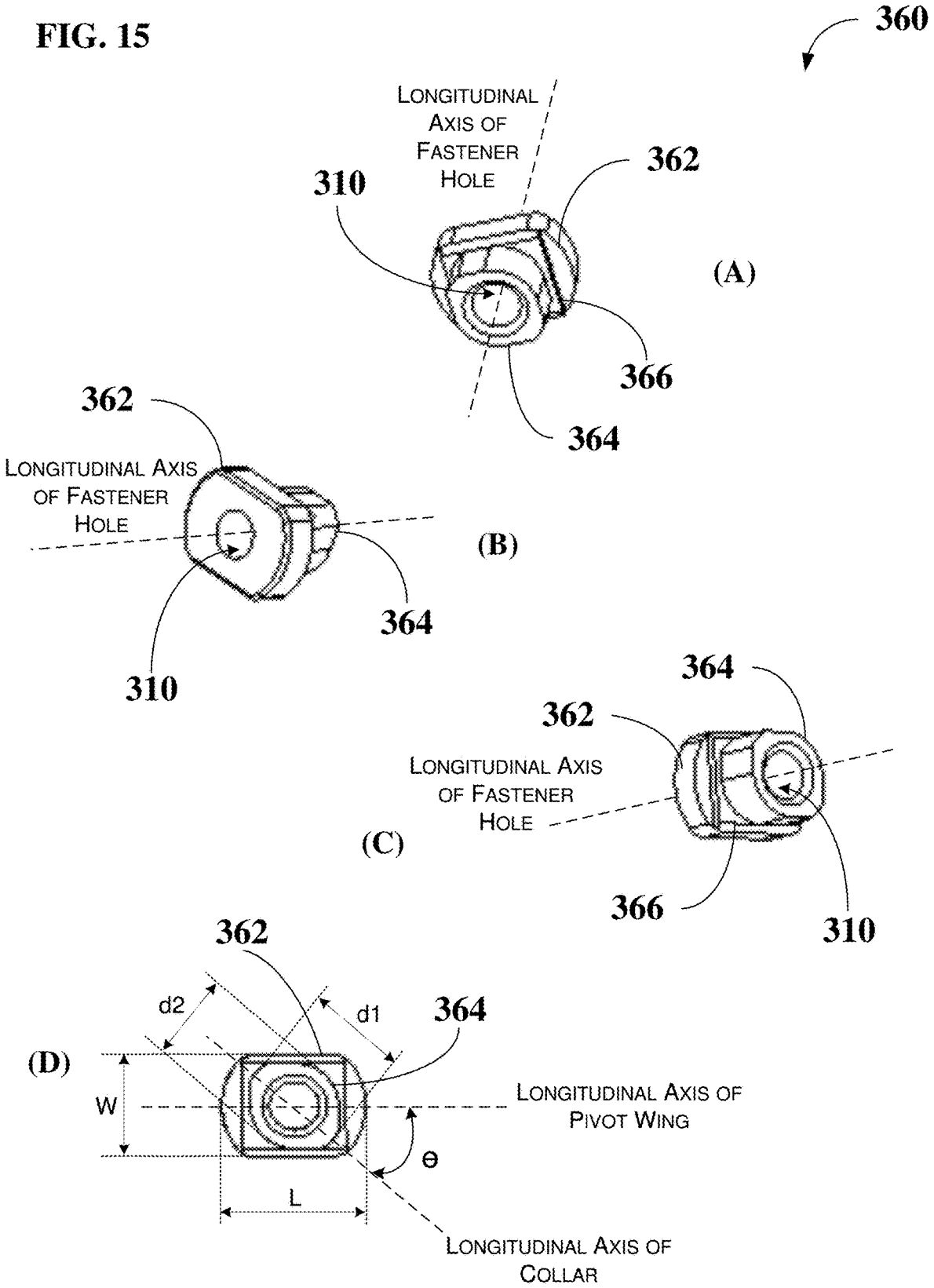
FIG. 15 is an illustration of various views of a fastener component in accordance with an implementation of the present disclosure.

FIG. 15 shows various views of pivot fastener nut 360. Pivot fastener nut 360 may include multiple components such as a threaded fastener through hole 310, a pivot wing 362 and a collar 364. In some alternative embodiments, pivot fastener nut 360 may also include a step portion 366 between pivot wing 362 and collar 364. In the example shown in FIG. 15, pivot wing 362 may be in an elongated shape that generally resembles a rectangle when viewed in a direction along a longitudinal axis of threaded fastener through hole 310. Moreover, in the example shown in FIG. 15, collar 364 may be in a quadrilateral shape that generally resembles a rhombus when viewed in a direction along the longitudinal axis of threaded fastener through hole 310. Furthermore, in the example shown in FIG. 15, step portion 366 may be in a quadrilateral shape that generally resembles a square or rectangle when viewed in a direction along the longitudinal axis of threaded fastener through hole 310.

Referring to parts (A)-(D) of FIG. 15, pivot wing 362 has two long sides that are opposite and parallel to each other and are relatively straight when viewed in a direction along a longitudinal axis of threaded fastener through hole 310. Additionally, referring to parts (A)-(D) of FIG. 15, pivot wing 362 also has two short sides that are opposite to each other and are curved (e.g., convex outwardly) when viewed in a direction along a longitudinal axis of threaded fastener through hole 310. Moreover, referring to part (D) of FIG. 15, an acute angle θ exists between a longitudinal axis of pivot wing 362 (or the generally rectangular shape thereof) and a longitudinal axis of collar 364 (or the generally rhombus shape thereof), and may be in a range between for example and without limitation, 30° and 60°. In some embodiments, the acute angle θ may be 45°. The generally rhombus shape of collar 364, as viewed in a direction along the longitudinal axis of threaded fastener through hole 310, may be considered as having four corners in which two opposing corners have acute angles and the other two opposing corners have obtuse angles or are otherwise rounded. Referring to part (D) of FIG. 15, a distance between the two corners with acute angle may be denoted as d1, and a distance between the two corners with obtuse angle (e.g., the two rounded corners) may be denoted as d2, with d1 greater than d2. Moreover, as shown in part (D) of FIG. 15, a dimension (e.g., length) of pivot wing 362 along the longitudinal axis thereof may be denoted as L, and a dimension (e.g., width) of pivot wing 362 along a direction perpendicular to the longitudinal axis thereof may be denoted as W, with L greater than W.

The dimensions L, W, d1 and d2 of pivot fastener nut 360 are chosen and configured to achieve specific purposes, as explained below.

With respect to keyhole-shaped openings 410 of the KeyMod handguard rail system, dimensions L and W are sufficiently small to allow pivot fastener nut 360 to be inserted through the larger and circular portion of the keyhole-shaped opening 410. Dimensions d1 and d2 are greater than the width of the smaller and narrower portion of the keyhole-shaped opening 410. Thus, with pivot wing 362 of pivot fastener nut 360 inserted through the keyhole-shaped opening 410 and with collar 364 received or otherwise engaged in the smaller and narrower portion of the keyhole-shaped opening 410, the dimension of the smaller and narrower portion of the keyhole-shaped opening 410 prevents collar 364 from turning or rotating. As fastener screw 350 is threaded into fastener hole 310 of pivot fastener nut 360, pivot fastener nut 360 is prevented from turning or rotating. This results in the longitudinal axis of pivot wing 362 remaining parallel to the longitudinal axis of multi-platform accessory rail 100A when fastener screw 350 and pivot fastener nut 360 together fasten or otherwise securely mount multi-platform accessory rail 100A on handguard 400 through some of its keyhole-shaped openings 410.

With respect to rounded-rectangular openings 420 of the M-LOK handguard rail system, dimension W of pivot wing 362 is less than the width of the rounded-rectangular opening 420 while dimension L of pivot wing 362 is greater than the width of the rounded-rectangular opening 420. This allows pivot fastener nut 360 to be inserted through the rounded-rectangular opening 420 in an orientation such that the longitudinal axis of pivot wing 362 is parallel to the longitudinal axis of multi-platform accessory rail 100A. While dimension L is greater than the width of the rounded-rectangular opening 420, dimensions d1, d2 and W are less than the width of the rounded-rectangular opening 420. On the other hand, referring to FIG. 18, fastener hole 103 may be configured as a combination of a larger recess 1038 on the bottom surface 114 and a smaller recess 103A on the top surface 112, resulting in a stepwise change in the diameter or width of fastener hole 103 between smaller recess 103A and larger recess 1038. This feature allows collar 364 of pivot fastener nut 360 to be seated, accommodated or otherwise received in the larger recess 103B of fastener hole 103. Moreover, the shape of the larger recess 1038 of fastener hole 103 is oblong or rounded-rectangular such that, given dimensions d1 and d2 of collar 364, collar 364 is allowed to turn or rotate in one direction up to 90° when seated, accommodated or otherwise received in the larger recess 103B of fastener hole 103. Thus, as fastener screw 350 is threaded into fastener hole 310 of pivot fastener nut 360, pivot fastener nut 360 is allowed to turn or rotate in one direction up to 90°. This results in the longitudinal axis of pivot wing 362 being perpendicular to the longitudinal axis of multi-platform accessory rail 100A when fastener screw 350 and pivot fastener nut 360 together fasten or otherwise securely mount multi-platform accessory rail 100A on handguard 400 through some of its keyhole-shaped openings 410. Advantageously, with pivot fastener nut 360 turned or rotated by 90°, dimension L of pivot wing 362 prevents pivot wing 362 (and hence pivot fastener nut 360) from slipping out of the rounded-rectangular opening 420, thereby fastening or securely mounting multi-platform accessory rail 100A on handguard 400 through some of its rounded-rectangular opening 420.

Figure 16A:
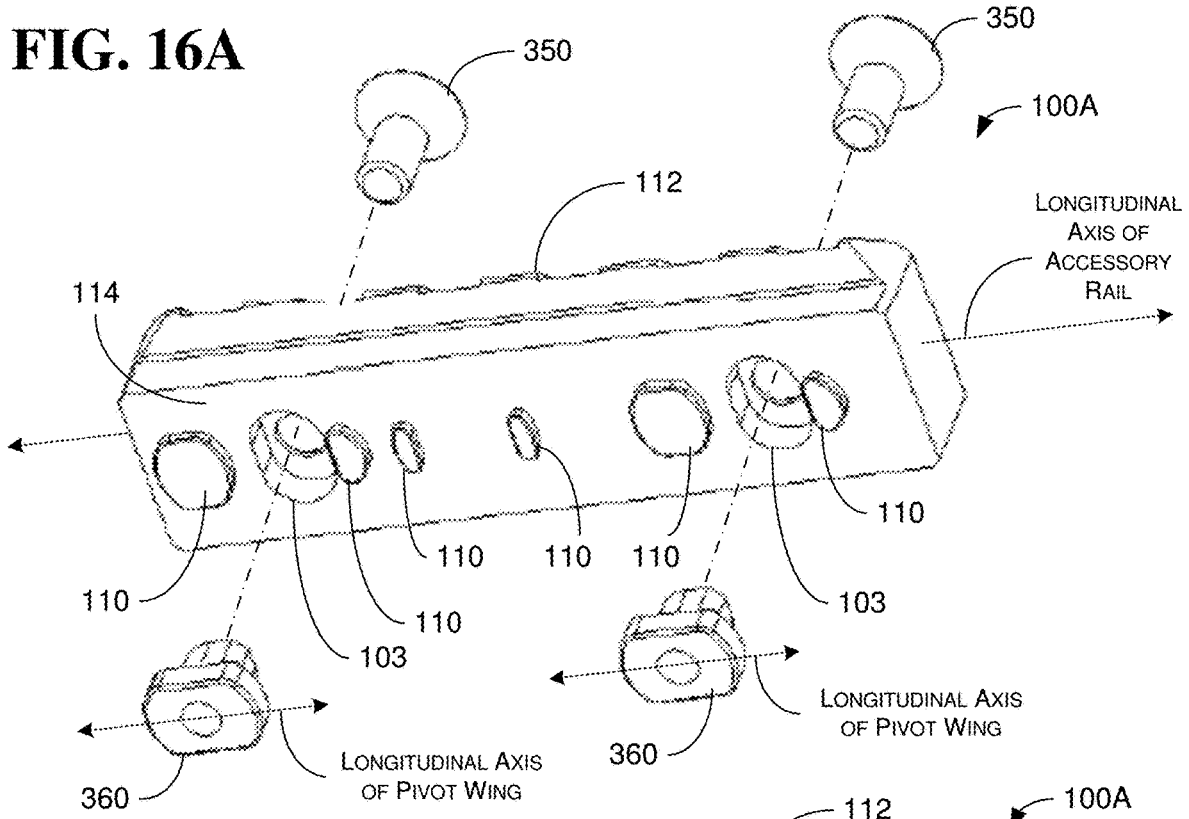
FIG. 16A-FIG. 16C are illustrations of ways of mounting a multi-platform accessory rail for mounting on a first firearm handguard rail system and a second firearm handguard rail system in accordance with an implementation of the present disclosure.
Figure 16B:
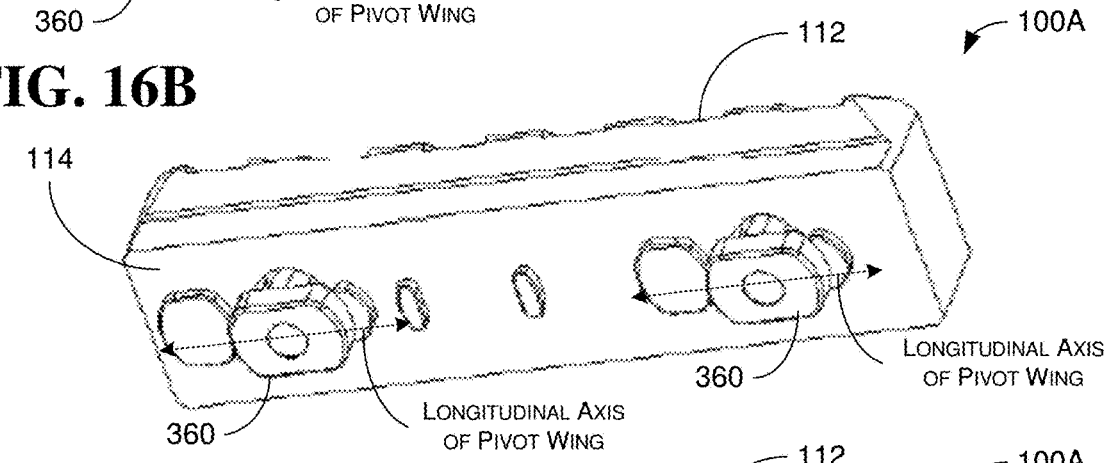
Figure 16C:
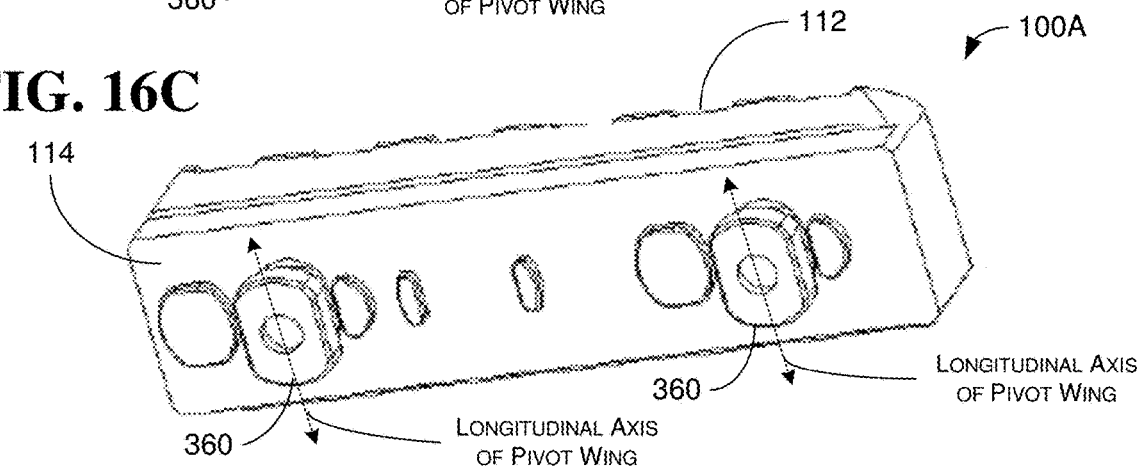

FIG. 16A-FIG. 16C show ways of mounting multi-platform accessory rail 100A for mounting on keyhole-shaped openings 410 of the KeyMod handguard rail system and rounded-rectangular openings 420 of the M-LOK handguard rail system in accordance with an implementation of the present disclosure. It is noteworthy that, in FIG. 16A-FIG. 16C, the handguard 400 (whether having keyhole-shaped openings 410 of the KeyMod handguard rail system or rounded-rectangular openings 420 of the M-LOK handguard rail system) is not shown to avoid obscuring the view of multi-platform accessory rail 100A, fastener screws 350 and pivot fastener nuts 360.

Referring to FIG. 16A, when mounting multi-platform accessory rail 100A on either keyhole-shaped openings 410 of the KeyMod handguard rail system or rounded-rectangular openings 420 of the M-LOK handguard rail system, pivot fastener nuts 360 are oriented in a way such that the longitudinal axis of pivot wing 362 of each pivot fastener nut 360 is parallel to a longitudinal axis of multi-platform accessory rail 100A. This orientation of pivot fastener nuts 360 allows the pivot fastener nuts 360 to be inserted into and through the keyhole-shaped openings 410 as well as the rounded-rectangular openings 420. Specifically, with respect to keyhole-shaped openings 410 of the KeyMod handguard rail system, when oriented as shown in FIG. 16A, the dimensions L and W of pivot wing 362 are sufficiently small to allow pivot fastener nut 360 to be inserted through the larger and circular portion of the keyhole-shaped opening 410. With respect to rounded-rectangular openings 420 of the M-LOK handguard rail system, dimension W of pivot wing 362 is less than the width of the rounded-rectangular opening 420 while dimension L of pivot wing 362 is greater than the width of the rounded-rectangular opening 420. This allows pivot fastener nut 360 to be inserted through the rounded-rectangular opening 420 in the orientation shown in FIG. 16A (i.e., longitudinal axis of pivot wing 362 parallel to longitudinal axis of multi-platform accessory rail 100A).

To fasten or otherwise securely mount multi-platform accessory rail 100A onto handguard 400, each fastener screw 350 is threaded into fastener hole 310 of a corresponding pivot fastener nut 360 by traversing through a corresponding fastener hole 103 (interchangeably referred as fastener hole), from top surface 112 of accessory rail 100A toward bottom surface 114 of multi-platform accessory rail 100A, and a keyhole-shaped opening 410 or a rounded-rectangular opening 420 of handguard 400 (not shown). When mounted on handguard 400, bottom surface 114 of multi-platform accessory rail 100A comes in contact with handguard 400. The alignment lugs 100 are spaced apart such that at least two of the alignment lugs 110 are adjacent to the rim of two distal ends of the same keyhole-shaped or rounded-rectangular opening or different keyhole-shaped or rounded-rectangular openings, thereby eliminating or at least minimizing the amount of linear movement of multi-platform accessory rail 100A (e.g., by sliding linearly) when mounted on handguard 400.

Referring to FIG. 16B, when mounted on keyhole-shaped openings 410 of the KeyMod handguard rail system, collar 364 of each pivot fastener nut 360 may be received in the constricted or narrow portion of the keyhole-shaped opening. Due to the generally rhombus shape of collar 364, collar 364 is prevented from turning or rotating due to physical contact with the constricted or narrow portion of the keyhole-shaped opening. Correspondingly, pivot fastener nut 360 is prevented from turning or rotating as the corresponding fastener screw 350 is fastened into the fastener hole 310 of pivot fastener nut 360. As a result, when multi-platform accessory rail 100A is securely mounted on handguard 400, the longitudinal axis of pivot wing 362 of each pivot fastener nut 360 remains parallel to a longitudinal axis of multi-platform accessory rail 100A.

Referring to FIG. 16C, when mounted on rounded-rectangular openings 420 of the M-LOK handguard rail system, collar 364 of each pivot fastener nut 360 may be received in the constant-width slot of the rounded-rectangular opening. Due to the generally rhombus shape of collar 364, collar 364 is allowed to turn or rotate in one direction up to 90° since the dimension d1 is greater than the width of the slot of the rounded-rectangular opening and since the dimension d2 is less than the width of the slot of the rounded-rectangular opening. Correspondingly, pivot fastener nut 360 turns or rotates 90° as the corresponding fastener screw 350 is fastened into the fastener hole 310 of pivot fastener nut 360. As a result, when multi-platform accessory rail 100A is securely mounted on handguard 400, the longitudinal axis of pivot wing 362 of each pivot fastener nut 360 becomes perpendicular with respect to the longitudinal axis of multi-platform accessory rail 100A.

Figure 17A:
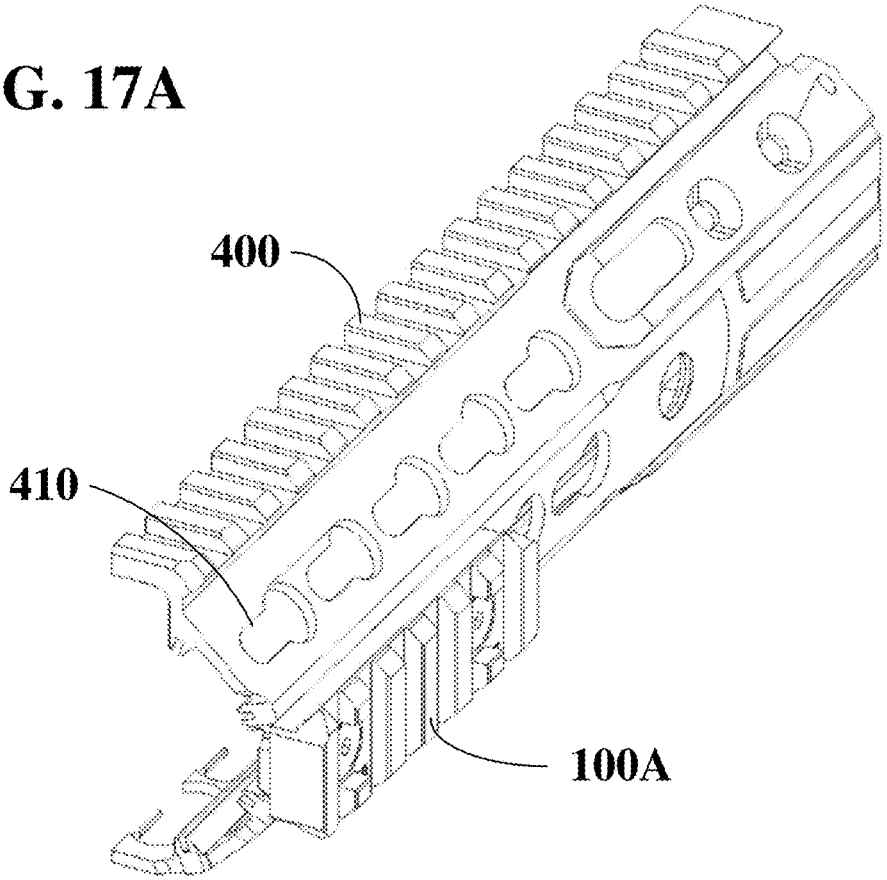
FIG. 17A and FIG. 17B are illustrations of a multi-platform accessory rail mounted on a first firearm handguard rail system and a second firearm handguard rail system in accordance with an implementation of the present disclosure.
Figure 17B:
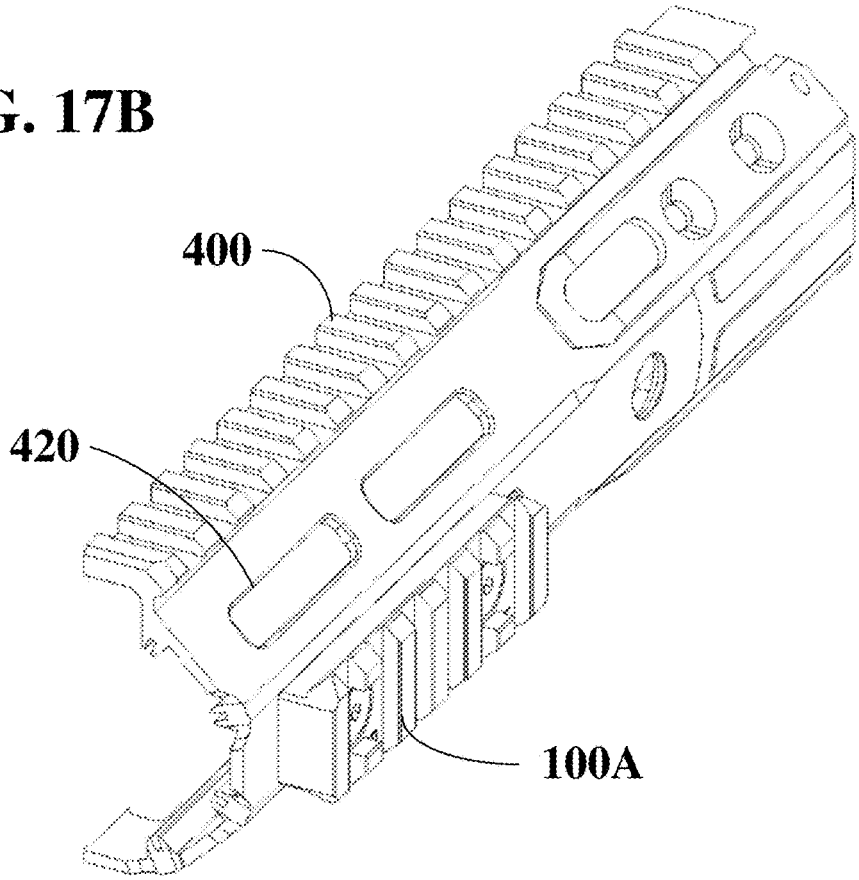

FIG. 17A and FIG. 17B are illustrations of multi-platform accessory rail 100A mounted on handguard 400 having keyhole-shaped openings 410 of the KeyMod handguard rail system or rounded-rectangular openings 420 of the M-LOK handguard rail system in accordance with an implementation of the present disclosure. In each of FIG. 17A and FIG. 17B, multi-platform accessory rail 100A may be mounted on keyhole-shaped openings 410 of the KeyMod handguard rail system and rounded-rectangular openings 420 of the M-LOK handguard rail system, respectively, with the use of fastener screws 350 and pivot fastener nuts 360.

Figure 18:
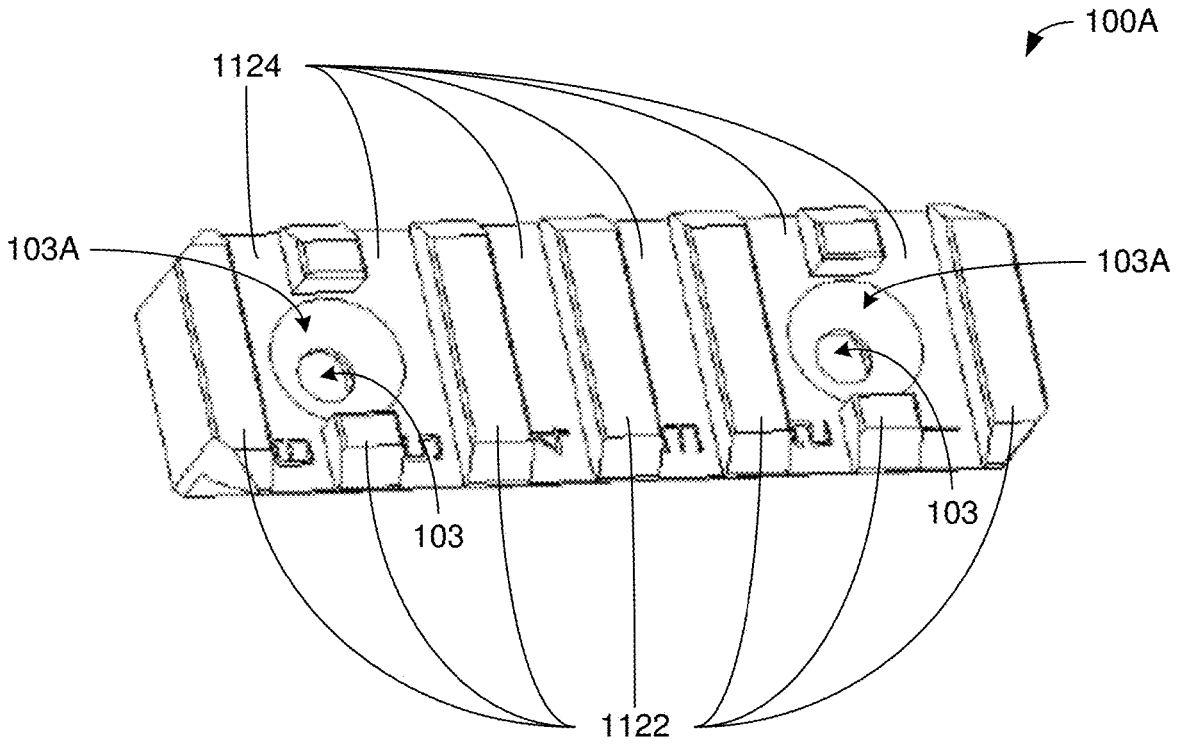
FIG. 18 is an illustration of a top surface and a bottom surface of a multi-platform accessory rail in accordance with an implementation of the present disclosure.
Figure 18:
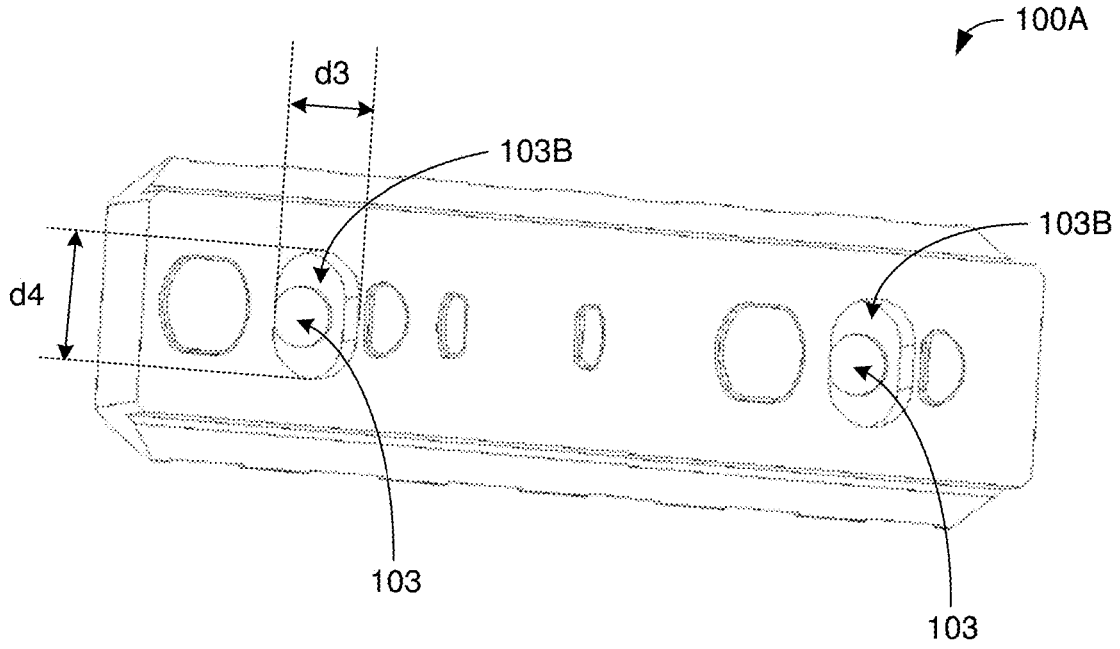

FIG. 18 is an illustration of top surface 112 of multi-platform accessory rail 100A in accordance with an implementation of the present disclosure. Referring to FIG. 18, top surface 112 of multi-platform accessory rail 100A may include a ribbed rail surface with multiple rail ribs 1122 and multiple grooves 1124 separating the rail ribs 1122 from each other. Rail ribs 1122 and grooves 1124 of multi-platform accessory rail 100A may form or otherwise constitute, for example and without limitation, a MIL-STD-1913 rail, a Standardization Agreement 2324 rail, a Picatinny rail, a Weaver rail, a STANAG 4694 rail, or a NATO accessory rail.

Referring to FIG. 18, fastener hole 103 may comprise a combination of larger recess 1038 on bottom surface 114 and smaller recess 103A on top surface 112, resulting in a stepwise change in the diameter or width of fastener hole 103 between smaller recess 103A and larger recess 103B. In some embodiments, smaller recess 103A may be generally conical in shape with a gradual and linear change in diameter. This feature allows collar 364 of pivot fastener nut 360 to be seated, accommodated or otherwise received in the larger recess 103B of fastener hole 103. Moreover, the shape of the larger recess 103B of fastener hole 103 is oblong or rounded-rectangular with dimensions d3 and d4 as shown in FIG. 18. Specifically, dimension d3 is less than dimension d1 and greater than dimension d2 of collar 364, and dimension d4 is greater than dimensions d1 and d2 of collar 364. This feature allows collar 364 to turn or rotate in one direction up to 90° when seated, accommodated or otherwise received in the larger recess 1038 of fastener hole 103. Thus, as fastener screw 350 is threaded into fastener hole 310 of pivot fastener nut 360, pivot fastener nut 360 is allowed to turn or rotate in one direction up to 90°.

In view of the above, with the user of pivot fastener nuts 360, multi-platform accessory rail 100A can be securely mounted on both keyhole-shaped openings 410 of the KeyMod handguard rail system and rounded-rectangular openings 420 of the M-LOK handguard rail system. It is noteworthy that, although examples and description above with respect to FIG. 10-FIG. 18 are provided in the context of accessory rail, concepts described therein are also applicable to multi-platform ergonomic foregrip 100. That is, multi-platform ergonomic foregrip 100 may also be securely mounted on both keyhole-shaped openings 410 of the KeyMod handguard rail system and rounded-rectangular openings 420 of the M-LOK handguard rail system with the use of pivot fastener nuts 360 and fastener screws 350 in accordance with the present disclosure. In other words, any device attachable to a firearm could benefit from the concepts described herein, and thus the scope and applicability of the present disclosure is not limited to accessory rails and foregrips.

Figure 19:
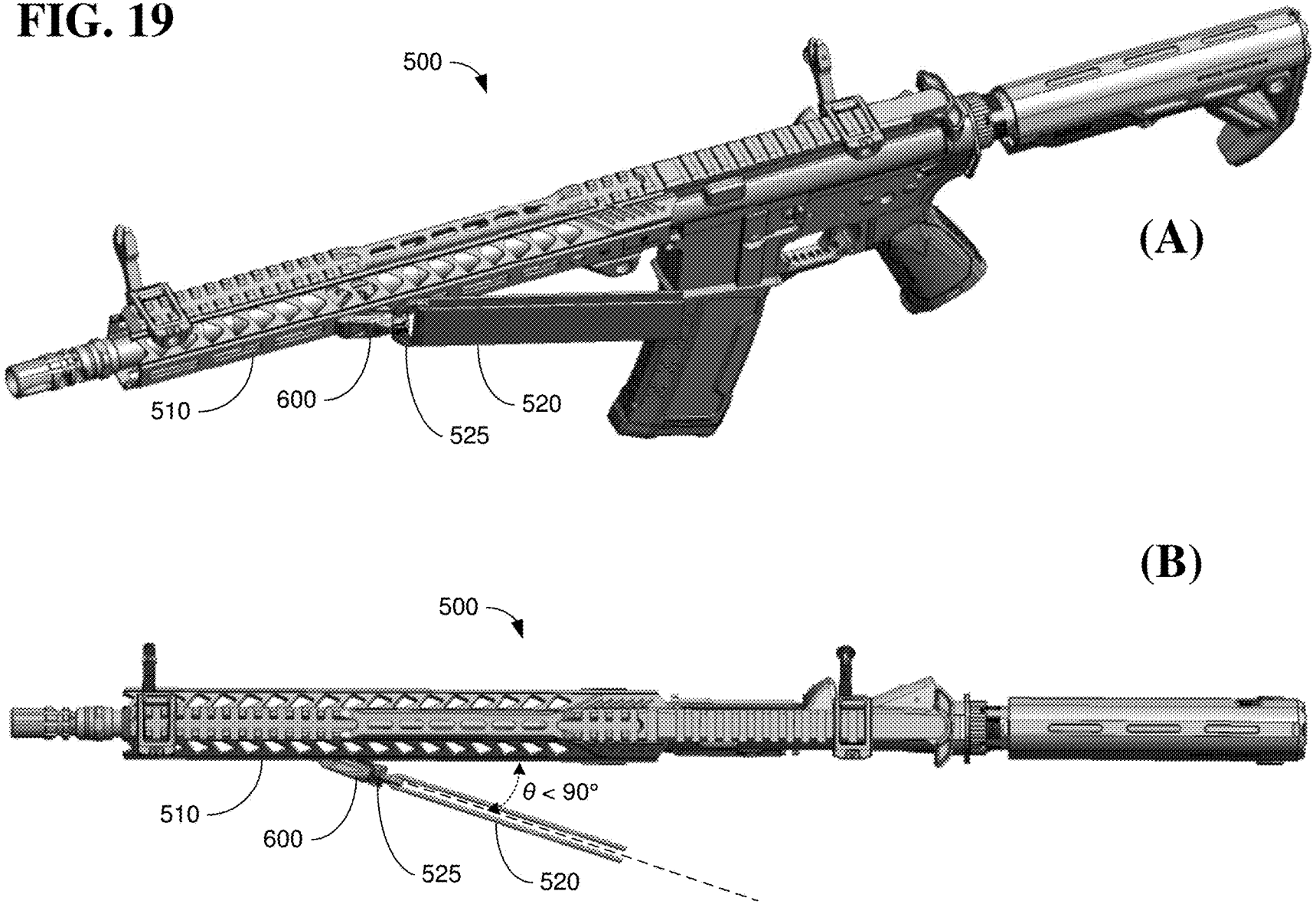
FIG. 19 is an illustration of an application of an example QD mount in accordance with an implementation of the present disclosure.
Figure 20:
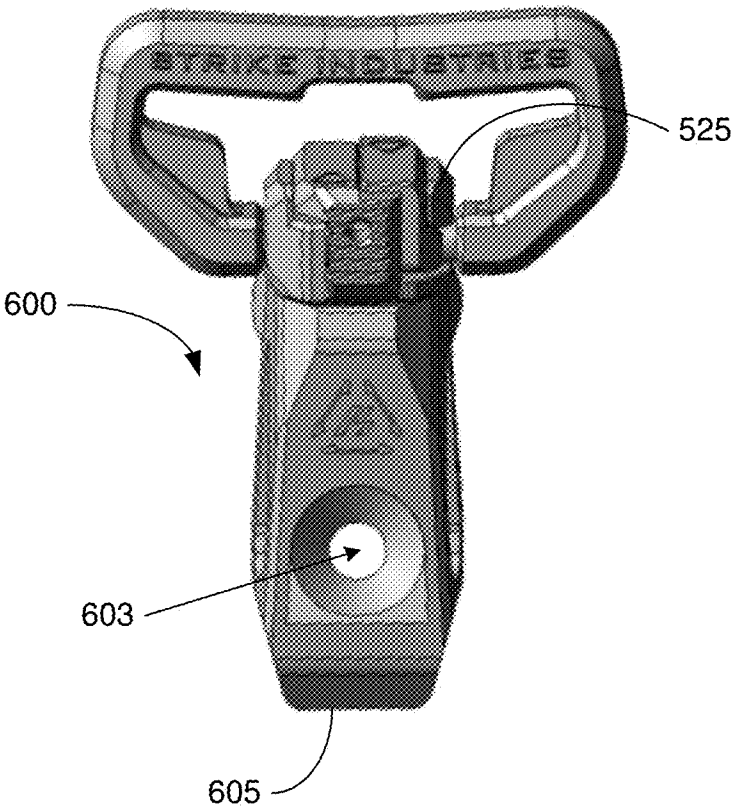
FIG. 20 is an illustration of an application of an example QD mount in accordance with an implementation of the present disclosure.
Figure 20:
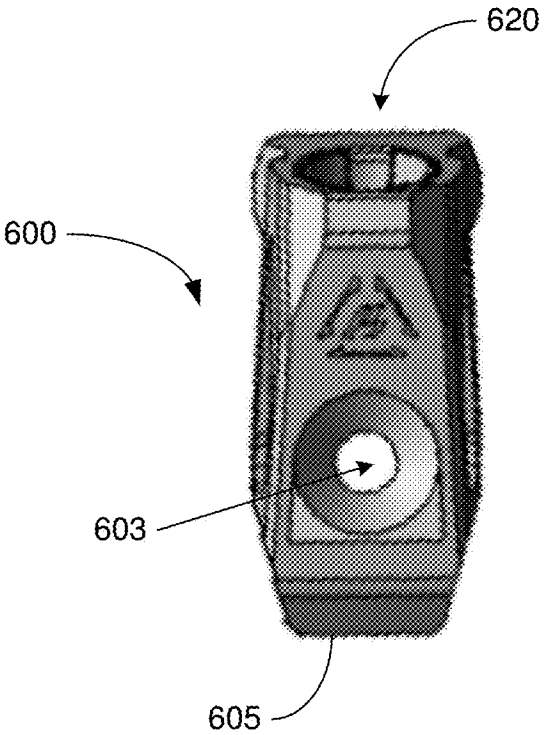
Figure 21:
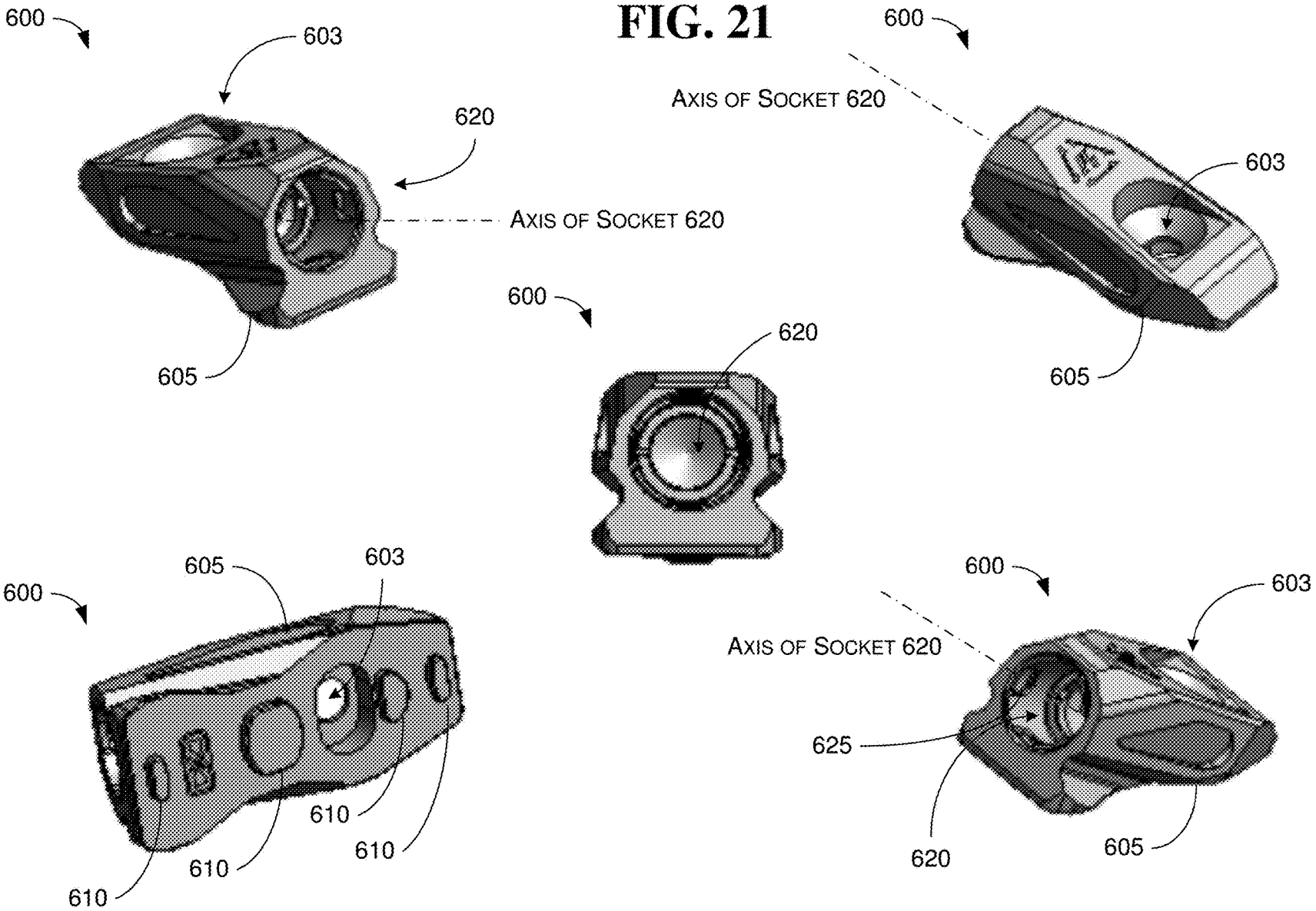
FIG. 21 is an illustration of various views of an example QD mount in accordance with an implementation of the present disclosure.

In FIG. 1-FIG. 9 the example detachable firearm attachment in accordance with an implementation of the present disclosure is in the form of a foregrip, and in FIG. 10-FIG. 18 the example detachable firearm attachment in accordance with an implementation of the present disclosure is in the form of an accessory rail. Similarly, certain inventive features of the present disclosure may be further extended to other applications, as shown in FIG. 19-FIG. 21. In FIG. 19-FIG. 21 the example detachable firearm attachment in accordance with an implementation of the present disclosure is in the form of QD mount. Description below regarding examples of a QD mount is provided with reference to FIG. 19-FIG. 21.

Parts (A) and (B) of FIG. 19 shows a firearm 500 on which an example QD mount 600 in accordance with an implementation of the present disclosure is utilized, installed or otherwise mounted. In particular, part (A) of FIG. 19 shows a perspective view and part (B) of FIG. 19 shows a top view. It is noteworthy that, although firearm 500 is shown in the form of an AR-style rifle (e.g., AR-15 or AR-10 semi-automatic rifle), QD mount 600 may be utilized, installed or otherwise mounted on other types of firearms such as, for example and without limitation, AR-style carbine, AR-style pistol, AR-style shotgun, AK-style rifle, AK-style carbine, AK-style pistol and AK-style shotgun.

Referring to FIG. 19, firearm 500 may include a handguard 510 which may employ the M-LOK handguard rail system/platform or the KeyMod handguard rail system/platform, and QD mount 600 may be installed or otherwise mounted on handguard 510. One or more QD-type accessories may be attached to firearm 500 via QD mount 600 by coupling to QD mount 600. In the example shown in FIG. 19, a QD sling 520 with a QD swivel 525 is shown to be a QD-type accessory that can be detachably coupled to and decoupled from QD mount 600.

Referring to FIG. 19-FIG. 21, QD mount 600 may include a main body 605 having a firearm attachment side and an accessory attachment side. The firearm attachment side (e.g., the side of QD mount 600 that faces and comes in contact with handguard 510 of firearm 500 when QD mount is installed or otherwise mounted on handguard 510 of firearm 500) may be configured to attach to a surface of a part (e.g., handguard 510) of firearm 500. The accessory attachment side of main body 605 may include a socket 620 that is configured such that a detachable device (e.g., QD swivel 525 of detachable sling 520) can be coupled to and decoupled from the socket along an axis of socket 620 that is at an angle θ less than 90° from the surface of the part of firearm 500, when viewed from the top (or bottom) of firearm 500, as shown in part (B) of FIG. 19. For instance, the angle θ may be 45° or a different angle in a range of 15°~75° or the range of 30°~60°.

As shown in FIG. 21, socket 620 of QD mount 600 may be configured with one or more indentation chambers 625 on a surface of a cavity of socket 620 in which the detachable device is received when the detachable device is coupled to socket 620. The one or more indentation chambers 625 provide anti-rotation function such that, when the detachable device (e.g., QD swivel 525) is coupled to or otherwise received in socket 620, a rotation of the detachable device is prevented by the one or more indentation chambers 625. In some implementations, each of the one or more indentation chambers 625 may be cut into the surface of the cavity of socket 620 not less than a certain distance (e.g., 0.97 millimeter) away from a surface of the accessory attachment side of main body 605.

As with other embodiments in accordance with the present disclosure, such as those shown in FIG. 1-FIG. 18, the firearm attachment side of main body 605 may be configured to attach to holes of a first handguard rail system (e.g., KeyMod) of a first handguard of firearm 500 and holes of a second handguard rail system (e.g., M-LOK) of a second handguard of firearm 500 such that: (i) the holes of the first handguard have a first shape and first dimensions, (ii) the holes of the second handguard have a second shape and second dimensions, (iii) the first shape and the second shape are different, and (iv) the first dimensions and the second dimensions are different. In some implementations, the first handguard rail system may include a plurality of key-hole shaped slots, and the second handguard rail system may include a plurality of rounded-square slots.

In some implementations, main body 605 of QD mount 600 may also be configured with an array of alignment lugs 610 protruding from the accessory attachment side of main body 605. The alignment lungs 610 are spaced apart such that at least two of the alignment lugs 610 are adjacent to a rim of two distal ends of two of the holes of the first handguard or two of the holes of the second handguard when main body 605 is fastened to the first handguard or the second handguard, respectively. Moreover, at least a first alignment lug 610 and a second alignment lug 610 of the array of alignment lugs 610 may be of different sizes or different shapes, as shown in FIG. 21.

In some implementations, main body 605 of QD mount 600 may be constructed with a durable aircraft-grade aluminum. Alternatively, main body 605 of QD mount 600 may be constructed with a different material (e.g., another metallic material or alloy, a polymer or a ceramic material). In some implementations, the firearm attachment side of main body 605 may be configured to interface with or mount on one type of interface (e.g., M-LOK or KeyMod or another system).

In some implementations, QD mount 600 may include a fastening device, which may be composed of a fastener hole 603 on main body 605 as well as a fastener screw and a pivot fastener nut (e.g., fastener screw 350 and pivot fastener nut 360) as described above with respect to FIG. 1-FIG. 18. For simplicity and in the interest of brevity, a detailed description of the fastening device is not repeated herein. However, highlights of features with respect to the fastening device of QD mount 600 are provided below.

Highlight of Select Features

In view of the above, highlights of certain features of a QD mount in accordance with the present disclosure are provided below.

In one aspect, a detachable firearm attachment implementable on a firearm may include a main body having a firearm attachment side and an accessory attachment side. The firearm attachment side may be configured to attach to a surface of a part of the firearm. The accessory attachment side may include a socket configured such that a detachable device is coupled to and decoupled from the socket along an axis of the socket that is at an angle less than 90° from the surface of the part of the firearm.

In some implementations, the angle may be 45° or a different angle in a range of 15°~75° or the range of 30°~60°.

In some implementations, the socket may be configured to receive a quick-detach (QD) swivel as the detachable device.

In some implementations, the socket may be further configured with one or more indentation chambers on a surface of a cavity of the socket in which the detachable device is received when the detachable device is coupled to the socket. When the detachable device is coupled to the socket, a rotation of the detachable device may be prevented by the one or more indentation chambers.

In some implementations, the firearm attachment side of the main body may be configured to attach to holes of a first handguard rail system of a first handguard of the firearm and holes of a second handguard rail system of a second handguard of the firearm such that: (i) the holes of the first handguard have a first shape and first dimensions, (ii) the holes of the second handguard have a second shape and second dimensions, (iii) the first shape and the second shape are different, and (iv) the first dimensions and the second dimensions are different.

In some implementations, the first handguard rail system may include a plurality of key-hole shaped slots, and the second handguard rail system may include a plurality of rounded-square slots.

In some implementations, the detachable firearm attachment may also include a fastening device with physical features such that, when the main body is attached to the firearm, the fastening device is configured to fasten the main body to the holes of the first handguard and to the holes of the second handguard.

In some implementations, the fastening device may include at least a fastener screw and at least a pivot fastener nut having a threaded fastener through hole configured to mate with threads of the fastener screw. In such cases, the main body may include at least a fastener hole communicatively connecting the first firearm attachment side and the accessory attachment side of the main body. Additionally, the fastening device may be configured to fasten the main body to the first handguard by fastening the main body and the first handguard between the fastener screw and the pivot fastener nut, with the fastener screws traversing through the fastener hole of the main body and one of the holes of the first handguard. Moreover, the fastening device may be configured to fasten the main body to the second handguard by fastening the main body and the second handguard between the fastener screw and the pivot fastener nut, with the fastener screws traversing through the fastener hole of the main body and one of the holes of the second handguard.

In some implementations, the fastener hole may include a first recess on the firearm attachment side of the main body and a second recess on the accessory attachment side of the main body. In such cases, a first size of the first recess and a second size of the second recess may be different. Moreover, a first shape of the first recess and a second shape of the second recess may be different.

In some implementations, the pivot fastener nut may include a pivot wing and a collar. In such cases, when the fastening device fastens the main body to either the first handguard or the second handguard, a cap of the fastener screw may be received in the second recess of the fastener hole and the collar of the pivot fastener nut may be received in the first recess of the fastener hole.

In some implementations, physical features of the pivot wing may be configured such that: (a) when inserting at least the pivot wing of the pivot fastener nut through the one of the holes of the first handguard to fasten the main body to the first handguard, a longitudinal axis of the pivot wing is parallel to a longitudinal axis of the main body, and (b) when inserting at least the pivot wing of the pivot fastener nut through the one of the holes of the second handguard to fasten the main body to the second handguard, the longitudinal axis of the pivot wing is parallel to the longitudinal axis of the main body.

In some implementations, physical features of the collar may be configured such that: (a) when the fastener screw is tightened in the threaded fastener through hole of the pivot fastener nut to fasten the main body to the first handguard, the longitudinal axis of the pivot wing is parallel to a longitudinal axis of the main body, and (b) when the fastener screw is tightened in the threaded fastener through hole of the pivot fastener nut to fasten the main body to the second handguard, the longitudinal axis of the pivot wing is perpendicular to the longitudinal axis of the main body.

In some implementations, a shape of the collar may generally resemble a rhombus when viewed in a direction along a longitudinal axis of the threaded fastener through hole.

In some implementations, a first dimension between two opposing corners of the rhombus with an acute angle may be greater than a second dimension between two opposing corners of the rhombus with an obtuse angle. In such cases, a shape of the first recess may generally resemble a rounded rectangle, and a length of the rounded rectangle may be greater than a width of the rounded rectangle.

In some implementations, the width of the rounded rectangle may be greater than the second dimension of the rhombus and less than the first dimension of the rhombus such that the pivot fastener nut is allowed to rotate in one direction up to 90° when received in the first recess.

In some implementations, the main body may further include an array of alignment lugs protruding from the accessory attachment side of the main body. In such cases, the alignment lungs may be spaced apart such that at least two of the alignment lugs are adjacent to a rim of two distal ends of two of the holes of the first handguard or two of the holes of the second handguard when the main body is fastened to the first handguard or the second handguard, respectively.

In some implementations, at least a first alignment lug and a second alignment lug of the array of alignment lugs may be of different sizes or different shapes.

In another aspect, a detachable firearm attachment implementable on a firearm may include a main body having a firearm attachment side and an accessory attachment side. The firearm attachment side may be configured to attach to a surface of a part of the firearm. The accessory attachment side may include a socket configured such that a detachable device is coupled to and decoupled from the socket along an axis of the socket that is at an angle less than 90° from the surface of the part of the firearm (e.g., 45° or a different angle in a range of 15°~75° or the range of 30°~60°). In such cases, the socket may be configured to receive a quick-detach (QD) swivel as the detachable device, and the socket may be further configured with one or more indentation chambers on a surface of a cavity of the socket in which the detachable device is received when the detachable device is coupled to the socket such that, when the detachable device is coupled to the socket, a rotation of the detachable device is prevented by the one or more indentation chambers.

In some implementations, the firearm attachment side of the main body may be configured to attach to holes of a first handguard rail system of a first handguard of the firearm and holes of a second handguard rail system of a second handguard of the firearm such that: (i) the holes of the first handguard have a first shape and first dimensions, (ii) the holes of the second handguard have a second shape and second dimensions, (iii) the first shape and the second shape are different, and (iv) the first dimensions and the second dimensions are different.

In some implementations, the first handguard rail system may include a plurality of key-hole shaped slots, and the second handguard rail system may include a plurality of rounded-square slots.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A detachable firearm attachment implementable on a firearm, comprising:

a main body having a firearm attachment side and an accessory attachment side, the firearm attachment side configured to attach to a surface of a part of the firearm, the accessory attachment side comprising a socket configured such that a detachable device is coupled to and decoupled from the socket along an axis of the socket that is at an angle less than 90° from the surface of the part of the firearm, wherein the firearm attachment side of the main body is configured to attach to holes of a first handguard rail system of a first handguard of the firearm and holes of a second handguard rail system of a second handguard of the firearm such that:

the holes of the first handguard have a first shape and first dimensions, the holes of the second handguard have a second shape and second dimensions, the first shape and the second shape are different, and the first dimensions and the second dimensions are different.

2. The detachable firearm attachment of claim 1, wherein the angle is 45°.

3. The detachable firearm attachment of claim 1, wherein the socket is configured to receive a quick-detach (QD) swivel as the detachable device.

4. The detachable firearm attachment of claim 1, wherein the socket is further configured with one or more indentation chambers on a surface of a cavity of the socket in which the detachable device is received when the detachable device is coupled to the socket, and wherein, when the detachable device is coupled to the socket, a rotation of the detachable device is prevented by the one or more indentation chambers.

5. The detachable firearm attachment of claim 1, wherein the first handguard rail system comprises a plurality of key-hole shaped slots, and wherein the second handguard rail system comprises a plurality of rounded-square slots.

6. The detachable firearm attachment of claim 1, further comprising:

a fastening device with physical features such that, when the main body is attached to the firearm, the fastening device is configured to fasten the main body to the holes of the first handguard and to the holes of the second handguard.

7. The detachable firearm attachment of claim 6, wherein the fastening device comprises:

at least a fastener screw; and at least a pivot fastener nut having a threaded fastener through hole configured to mate with threads of the fastener screw, wherein the main body comprises at least a fastener hole communicatively connecting the first firearm attachment side and the accessory attachment side of the main body, wherein the fastening device is configured to fasten the main body to the first handguard by fastening the main body and the first handguard between the fastener screw and the pivot fastener nut, with the fastener screws traversing through the fastener hole of the main body and one of the holes of the first handguard, and wherein the fastening device is configured to fasten the main body to the second handguard by fastening the main body and the second handguard between the fastener screw and the pivot fastener nut, with the fastener screws traversing through the fastener hole of the main body and one of the holes of the second handguard.

8. The detachable firearm attachment of claim 7, wherein the fastener hole comprises a first recess on the firearm attachment side of the main body and a second recess on the accessory attachment side of the main body, wherein a first size of the first recess and a second size of the second recess are different, and wherein a first shape of the first recess and a second shape of the second recess are different.

9. The detachable firearm attachment of claim 8, wherein the pivot fastener nut comprises:

a pivot wing; and a collar, wherein, when the fastening device fastens the main body to either the first handguard or the second handguard, a cap of the fastener screw is received in the second recess of the fastener hole and the collar of the pivot fastener nut is received in the first recess of the fastener hole.

10. The detachable firearm attachment of claim 9, wherein physical features of the pivot wing are configured such that:

when inserting at least the pivot wing of the pivot fastener nut through the one of the holes of the first handguard to fasten the main body to the first handguard, a longitudinal axis of the pivot wing is parallel to a longitudinal axis of the main body, and when inserting at least the pivot wing of the pivot fastener nut through the one of the holes of the second handguard to fasten the main body to the second handguard, the longitudinal axis of the pivot wing is parallel to the longitudinal axis of the main body.

11. The detachable firearm attachment of claim 10, wherein physical features of the collar are configured such that:

when the fastener screw is tightened in the threaded fastener through hole of the pivot fastener nut to fasten the main body to the first handguard, the longitudinal axis of the pivot wing is parallel to a longitudinal axis of the main body, and when the fastener screw is tightened in the threaded fastener through hole of the pivot fastener nut to fasten the main body to the second handguard, the longitudinal axis of the pivot wing is perpendicular to the longitudinal axis of the main body.

12. The detachable firearm attachment of claim 11, wherein a shape of the collar generally resembles a rhombus when viewed in a direction along a longitudinal axis of the threaded fastener through hole.

13. The detachable firearm attachment of claim 12, wherein a first dimension between two opposing corners of the rhombus with an acute angle is greater than a second dimension between two opposing corners of the rhombus with an obtuse angle, wherein a shape of the first recess generally resembles a rounded rectangle, and wherein a length of the rounded rectangle is greater than a width of the rounded rectangle.

14. The detachable firearm attachment of claim 13, wherein the width of the rounded rectangle is greater than the second dimension of the rhombus and less than the first dimension of the rhombus such that the pivot fastener nut is allowed to rotate in one direction up to 90° when received in the first recess.

15. The detachable firearm attachment of claim 9, wherein the main body further comprises an array of alignment lugs protruding from the accessory attachment side of the main body, wherein the alignment lungs are spaced apart such that at least two of the alignment lugs are adjacent to a rim of two distal ends of two of the holes of the first handguard or two of the holes of the second handguard when the main body is fastened to the first handguard or the second handguard, respectively.

16. The detachable firearm attachment of claim 15, wherein at least a first alignment lug and a second alignment lug of the array of alignment lugs are of different sizes or different shapes.

17. A detachable firearm attachment implementable on a firearm, comprising:

a main body having a firearm attachment side and an accessory attachment side, the firearm attachment side configured to attach to a surface of a part of the firearm, the accessory attachment side comprising a socket configured such that a detachable device is coupled to and decoupled from the socket along an axis of the socket that is at an angle less than 90° from the surface of the part of the firearm, wherein the angle is 45°, wherein the socket is configured to receive a quick-detach (QD) swivel as the detachable device, wherein the socket is further configured with one or more indentation chambers on a surface of a cavity of the socket in which the detachable device is received when the detachable device is coupled to the socket, wherein, when the detachable device is coupled to the socket, a rotation of the detachable device is prevented by the one or more indentation chambers, and wherein the firearm attachment side of the main body is configured to attach to holes of a first handguard rail system of a first handguard of the firearm and holes of a second handguard rail system of a second handguard of the firearm such that:

the holes of the first handguard have a first shape and first dimensions, the holes of the second handguard have a second shape and second dimensions, the first shape and the second shape are different, and the first dimensions and the second dimensions are different.

18. The detachable firearm attachment of claim 17, wherein the first handguard rail system comprises a plurality of key-hole shaped slots, and wherein the second handguard rail system comprises a plurality of rounded-square slots.

* * * * *